US007310921B2

(12) United States Patent
Williams

(10) Patent No.: US 7,310,921 B2
(45) Date of Patent: Dec. 25, 2007

(54) METHOD AND ARTICLE OF MANUFACTURE FOR SEALING A ROOF

(76) Inventor: Douglas C. Williams, 2300 W. Westport, Peoria, IL (US) 61615

( * ) Notice: Subject to any disclaimer, the term of this patent is extended or adjusted under 35 U.S.C. 154(b) by 0 days.

(21) Appl. No.: 10/993,018

(22) Filed: Nov. 19, 2004

(65) Prior Publication Data

US 2005/0102922 A1 May 19, 2005

Related U.S. Application Data

(63) Continuation of application No. 10/037,632, filed on Jan. 3, 2002, now abandoned.

(51) Int. Cl.
*E04B 1/00* (2006.01)
*E04G 21/00* (2006.01)
*E04G 23/00* (2006.01)

(52) U.S. Cl. ..... 52/746.11; 52/515; 52/408; 52/DIG. 16

(58) Field of Classification Search ..... 52/746.11, 52/94, 404.1, 515, 408, DIG. 16
See application file for complete search history.

(56) References Cited

U.S. PATENT DOCUMENTS 2,044,782 A * 6/1936 Harshberger ..... 52/232
2,144,168 A * 1/1939 Sherriff ..... 52/420
2,226,239 A * 12/1940 Elmendorf ..... 52/409
2,246,514 A * 6/1941 Hardy ..... 52/746.11
3,900,102 A * 8/1975 Hurst ..... 206/411
4,160,346 A * 7/1979 Kaufmann ..... 52/96
4,172,830 A * 10/1979 Rosenberg et al. ..... 156/249
4,194,335 A 3/1980 Diamond
4,601,935 A 7/1986 Metcalf et al.
4,775,567 A 10/1988 Harkness
4,825,616 A * 5/1989 Bondoc et al. ..... 52/518
4,965,119 A 10/1990 Sancaktar
4,992,315 A 2/1991 Zickell et al.

(Continued)

*Primary Examiner*—Richard E. Chilcot, Jr.
*Assistant Examiner*—Chi Q. Nguyen
(74) *Attorney, Agent, or Firm*—Husch & Eppenberger LLC; Robert C. Haldiman

(57) ABSTRACT

A process of pre-applying a vapor, water and ice layer to a sheathing panel before the sheathing panel is assembled onto rafters of a roof is disclosed, comprising the steps of positioning a face of the sheathing panel for accessibility, removing a plastic film from the vapor, water and ice layer, thereby exposing an adhesive surface of the vapor, water and ice layer, joining the adhesive surface of the vapor, and water and ice layer to the face of the sheathing panel to form an assembly, thereafter, transporting the assembly to the roof, and securing the assembly to the rafters of the roof.

An article of manufacture for reducing water and ice damage caused by an ice dam on a roof is disclosed, wherein the article of manufacture is pre-assembled prior to assembly to rafters of the roof, comprising a sheathing panel for assembling on the rafters of the roof having a first face and a second face, a vapor, water and ice layer having a first side and a second side, the second side having a plastic film covering an adhesive backing, means for removing the plastic film to expose the adhesive backing and means for assembling the vapor, water and ice layer to the sheathing panel, wherein the second side of the vapor, water and ice layer having the adhesive backing is placed onto the first face of sheathing panel before assembly of the sheathing panel to the rafters of the roof.

4 Claims, 3 Drawing Sheets

U.S. PATENT DOCUMENTS

| | | | | |
|---|---|---|---|---|
| 5,096,759 | A | 3/1992 | Simpson et al. | |
| 5,843,552 | A | 12/1998 | Karrfalt | |
| 6,023,906 | A | 2/2000 | Folkersen | |
| 6,209,283 | B1 | 4/2001 | Folkersen | |
| 6,235,365 | B1 | 5/2001 | Schaughency et al. | |
| 6,701,685 | B2 * | 3/2004 | Rippey | 52/408 |
| 6,769,215 | B1 * | 8/2004 | Carkner | 52/411 |
| 6,804,922 | B1 * | 10/2004 | Egan | 52/408 |
| 2001/0010141 | A1 | 8/2001 | Folkersen | |
| 2003/0054127 | A1 | 3/2003 | Heifetz | |

* cited by examiner

METHOD AND ARTICLE OF MANUFACTURE FOR SEALING A ROOF

CROSS-REFERENCE TO RELATED APPLICATIONS

This is a divisional application claiming priority of application Ser. No.: 10/037,632 filed on Jan. 3, 2002.

STATEMENT REGARDING FEDERALLY SPONSORED RESEARCH OR DEVELOPMENT

Not Applicable.

APPENDIX

Not Applicable.

1. Technical Field of the Invention

This invention relates generally to a sealed roof and more particularly to a method and article of manufacture for sealing a roof against vapor penetration, water leakage and ice damage.

2. Description of the Related Art

Many structures are damaged due to the build-up of ice or ice dams on their roofs during the winter months. For example, snow may accumulate on a roof and create an insulating layer between the outside environment and the roof. As residual heat escapes from the structure through the roof, the snow in the proximity of the roof begins to melt and the water runs down the roof under the snow as is the case in a rain storm. Normally, water exits the roof by passing over the eaves and off the roof or down a drainage system.

Under certain cold conditions, the temperature of the roof areas above the eaves is below the freezing point, because they are not heated by the residual heat escaping from the structure. As a result, the water freezes as it contacts the cold roof area over the eaves. This causes ice to build up on the roof over the eaves, which forms a barricade or an ice dam. The water behind the ice dam and on the roof remains in a liquid form due to the residual heat escaping from the structure. Pitched shingled, shaked, tiled or slated roofs are constructed by overlapping shingles, shakes, tiles or slates (hereinafter collectively "shingles"; therefore, the standing water behind the ice dam may seep under the shingles and into the structure causing water damage.

Most overlaid shingled roofs are not designed to seal against the standing water caused by ice dams. They are designed, through their overlaid placement, to seal against water running off the roof. When water stands on a pitched shingled roof, the water seeps under the shingles, through the sheathing and into the structure. Water damage is aesthetically unappealing, very costly to repair and can lead to the proliferation of mold, which has been known to cause health problems in humans.

There are construction devices and methods used to protect structures from damage caused by water standing on their pitched shingled roofs due to ice dams. These devices and methods include placing low friction roof elements on the eaves, so the ice slides off the roof. Some systems use electric heaters placed upon the eaves to melt the ice dams or to keep them from forming. Another way to prevent water damage to the structure is by placing a waterproof membrane on the sheathing and under the shingles. In the event an ice dam occurs, the membrane seals the structure from the standing water, preventing water from contacting the sheathing.

The following is a simplistic overview of the process for assembling a roof. Sheathing is secured to the rafters or roof frame. In most cases, a 4 feet in width by 8 feet in length piece of plywood having a thickness of ½" to ¾" is used as sheathing. A vapor barrier is placed on the sheathing of the roof. The vapor barrier commonly used is 15#-30# tar paper that is available in 3' rolls. The vapor barrier is not effective in precluding leakage caused by ice dams. Based on this, quality builders will assemble a vapor-, water- and ice-resistant layer along the eaves and valleys of the roofs to preclude, inter alia, water leakage due to ice dams. The vapor-, water- and ice-resistant layer is placed along the edges of the roof or eaves in lieu of the vapor barrier or tar paper. In addition, the vapor-, water- and ice-resistant layer is placed in other areas of the roof prone to water leakage, such as the valleys, in lieu of the vapor barrier or tar paper. The vapor- and water-resistant layer usually comes in 3' rolls, and the industry standard is a 0.040" thick vapor-, water- and ice-resistant layer. There are various manufacturers of and names used for the vapor-, water- and ice-resistant layer. For example, GAF Corporation located at 1361 Alps Road, Wayne, N.J. 07470 is the owner of the Weather Watch® trademark registration for roofing membranes, and Owens-Corning Fiberglas Technology Inc. located at 7734 West 59$^{th}$ Street, Summit, Ill. 60501 is the owner of the WeatherGuard® trademark registration for similar goods. It is important to note that there are other manufacturers of and products that are vapor-, water- and ice-resistant for precluding water leakage caused by ice dams. After placing the tar paper and vapor-, water- and ice-resistant layer in the appropriate locations on the roof, shingles are placed thereon in an overlapping construction from the lower portion of the pitched roof to the peak of the pitched roof as previously explained. For example, the first column of shingles placed along the lowest portion of the pitched roof is overlapped by the second column of shingles. This overlap construction continues upward until the peak of the roof is reached.

Turning now to the vapor-, water- and ice-resistant layer, it is generally supplied in 3' wide rolls having an adhesive backing that adheres to the sheathing. The adhesive backing is temporarily protected with a plastic film, which is removed prior to assembly to the sheathing panel. In most cases, the vapor-, water- and ice-resistant layer is placed along the eaves, which are subjected to ice dams, and other problematic areas prone to leakage. These rolls are heavy and difficult to manipulate and carry up to the roof. Once on the roof, the roll is unrolled along the length of the roof that is to receive the vapor-, water- and ice-resistant layer. This process is very difficult to perform on a pitched roof and can be dangerous. The adhesive backing is exposed by peeling off the plastic film covering the adhesive on the back of the vapor-, water- and ice-resistant layer. The vapor-, water- and ice-resistant layer is placed on the roof and secured thereto. This process is very difficult to perform on a pitched roof and can be dangerous. In hot weather, the adhesive backing is very tacky and difficult to handle. Improper placement of the vapor-, water- and ice-resistant layer results in, inter alia, kinks, seams and non-uniform coverage. In cold weather, the adhesive backing does not stick well to the sheathing and is difficult to align and secure to the sheathing. In windy conditions, handling the vapor-, water- and ice-resistant layer is problematic. Walking along the edges of a roof is dangerous without these adverse conditions. Moreover, combine any of these conditions and the placement of the vapor-, water- and ice-resistant layer is extremely difficult and hazardous.

The present invention is directed to overcoming one or more of the problems or disadvantages set forth above.

SUMMARY OF THE INVENTION

An aspect of the present invention is to provide an article of manufacture for overcoming one or more of the problems and disadvantages set forth above.

It is an aspect of this invention to provide a method for waterproofing roofs.

In another aspect of the invention, there is a method of assembling a layer of vapor, water and ice resistant material onto a sheathing panel to form an ice dam for use in roof construction before the sheathing panel is secured onto roof rafters, the vapor, water and ice resistant material having on one side thereof an adhesive surface covered with a plastic film, comprising the steps of positioning a face of the sheathing panel in a generally horizontal plane for accessibility in a controlled atmosphere, removing the plastic film from the vapor, water and ice layer, thereby exposing the adhesive surface of the vapor, water and ice layer, positioning a corner of the vapor, water and ice layer at a corner of the sheathing panel and aligning their longitudinal edges and pressing the adhesive surface of the vapor, and water and ice layer to the face of the sheathing panel to form an assembly, thereby forming an ice dam for use in roof construction.

Another aspect of this invention is to provide an article of manufacture for waterproofing roofs.

In another aspect of the invention, there is a pre-assembled article of manufacture providing a vapor, water and ice barrier for roofs.

In yet another aspect of the invention, there is provided a method for pre-installing a vapor, water and ice barrier prior to placement on the roof.

In still yet another aspect of the invention, there is provided a method for pre-applying a vapor, water and ice barrier on sheathing panels for roofs.

In still another aspect of the invention, there is provided a sheathing panel having a pre-applied vapor, water and ice barrier thereon.

These, and other aspects and advantages of the present invention, will become apparent as the invention becomes better understood from the Detailed Description, appended claims and the accompanying drawings.

BRIEF DESCRIPTION OF THE DRAWINGS

Reference is now made to the drawings, which illustrate the best known mode for carrying out the invention, and wherein similar reference characters indicate the same parts throughout the several views.

DETAILED DESCRIPTION

Figure 1:
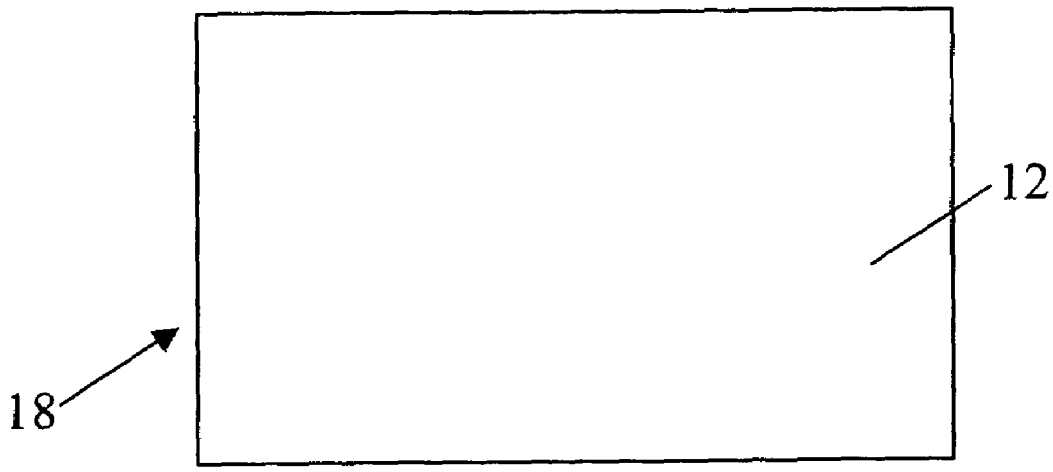
FIG. 1 is a front view showing an assembly of a sheathing panel having the vapor, water and ice barrier placed thereon.

FIGS. 1-4 show two different embodiments of the present invention comprising a sheathing panel 11 having a vapor, water and ice layer 12 attached thereto. The vapor, water and ice layer 12 precludes vapor penetration and ice or water damage to the structure. In most cases, the sheathing panel 11 is 4' in width by 8' in length having a thickness of ½" to ¾". However, the dimensions of the sheathing panel 11 are not limiting, and the invention can be practiced with different size sheathing panels 11. The vapor, water and ice layer 12 is supplied in rolls having different widths and having a thickness of approximately 0.040". However, the dimensions of the vapor, water and ice layer 12 are not limiting, and the invention can be practiced with different size vapor, water and ice layers 12.

Figure 3:
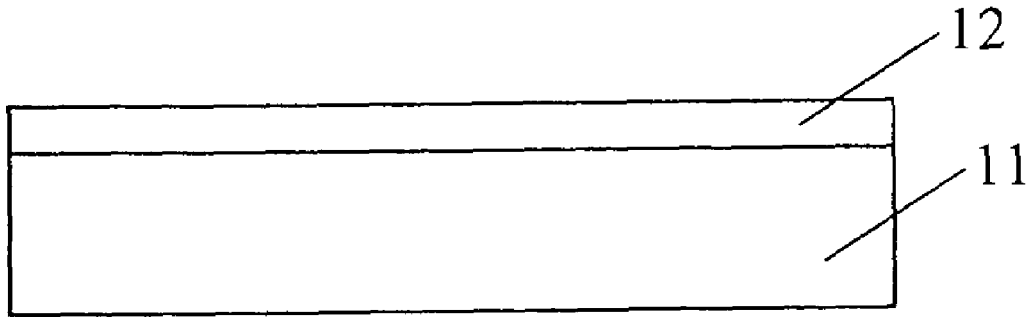
FIG. 3 is a side view showing the assembly of the sheathing panel having the vapor, water and ice barrier placed thereon according to FIG. 1.
Figure 5:
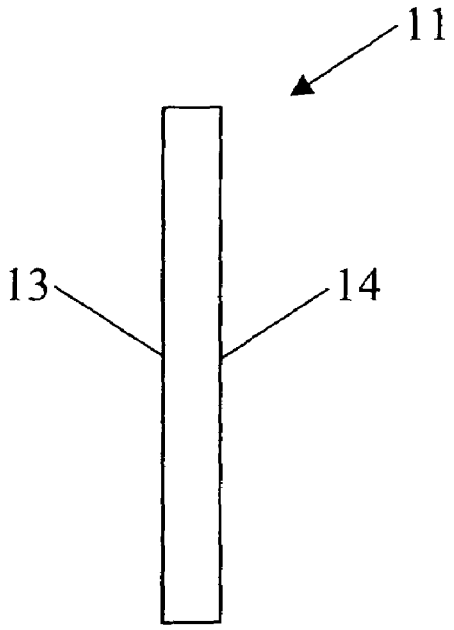
FIG. 5 is a side view of the sheathing panel without the vapor, water and ice barrier placed thereon.
Figure 6:
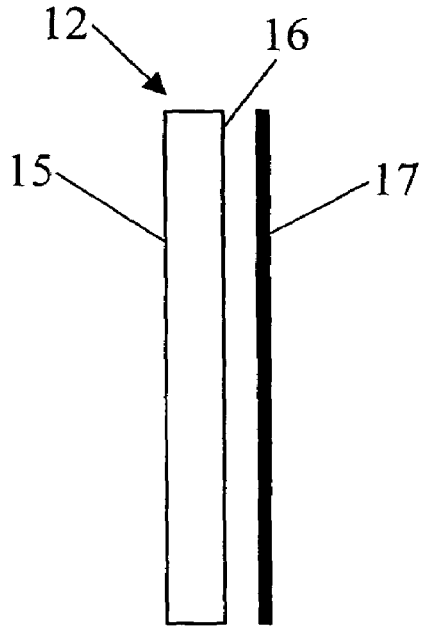
FIG. 6 is a side view of the vapor, water and ice barrier.

FIGS. 1 and 3 show a first embodiment of the invention. The sheathing panel 11 has a first face 13 and a second face 14 as shown in FIG. 5. The sheathing panel 11 is positioned so that the first face 13 or second face 14 is accessible. The vapor, water and ice layer 12 has a first side 15 and a second side 16 as shown in FIG. 6. In the preferred embodiment, the second side 16 has a plastic film 17 covering an adhesive backing (not shown) on the second side 16. The plastic film 17 is removed or peeled off of the vapor, water and ice layer 12, thereby exposing the adhesive backing. The vapor, water and ice layer 12 is applied to either the first face 13 or the second face 14 of the sheathing panel 11 so that the adhesive backing contacts and adheres to the first face 13 or second face 14 of the sheathing panel 11. In alternative embodiments, the sheathing panel 11 has a pre-applied layer of adhesive on the first face 13 or the second face 14, and the vapor, water and ice layer 12 does not have any adhesive backing. In this embodiment, the sheathing panel 11 is positioned so that the first face 13 or second face 14 having the pre-applied adhesive is accessible. The first side 15 or the second side 16 of the vapor, water and ice layer 12 is placed onto the first face 13 or second face 14 having the pre-applied adhesive so that the adhesive contacts and adheres to the first side 15 or second side 16 of the vapor, water and ice layer 12. The adhesive on the sheathing panel 11 may or may not be covered with a plastic or other similar strip (not shown). This strip protects the adhesive during shipping and handling. If a strip is covering the adhesive, it is obvious that the strip should be removed before assembling the vapor, water and ice layer 12 thereto. In another embodiment, both the sheathing panel 11 and the vapor, water and ice layer 12 have the pre-applied adhesive layer. In another embodiment, the sheathing panel 11 and the vapor, water and ice layer 12 do not have the pre-applied adhesive layer. Rather, adhesive is applied during assembly of the sheathing panel 11 and the vapor, water and ice layer 12. In the embodiment shown in FIGS. 1 and 3, the vapor, water and ice layer 12 substantially covers the entire first face 13 or the entire second face 14 of the sheathing panel 11. However, it is important to note that the coverage of the first face 13 or the second face 14 of the sheathing panel 11 is not limiting and can be adjusted according to the purpose of use.

Figure 2:
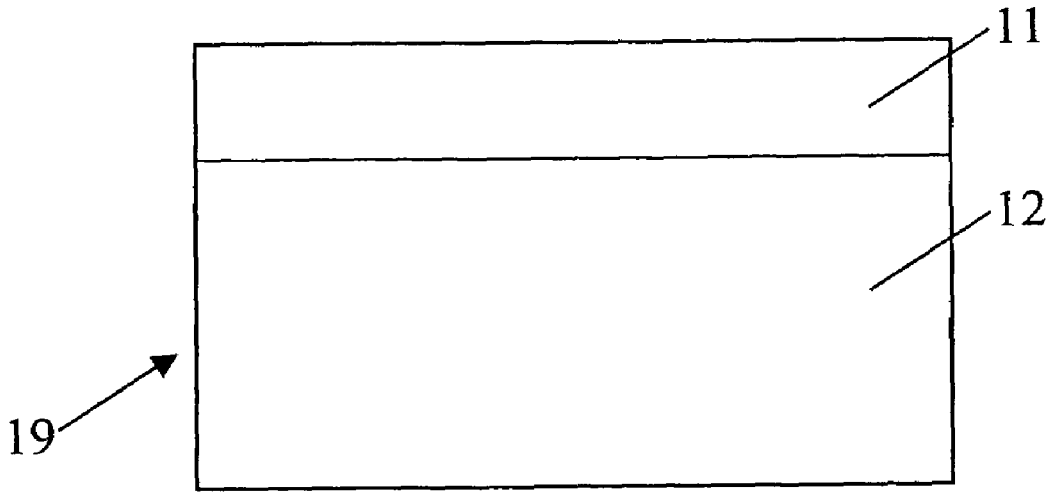
FIG. 2 is a front view showing the assembly of the sheathing panel having the vapor, water and ice barrier placed thereon in an alternative embodiment of the invention.
Figure 4:
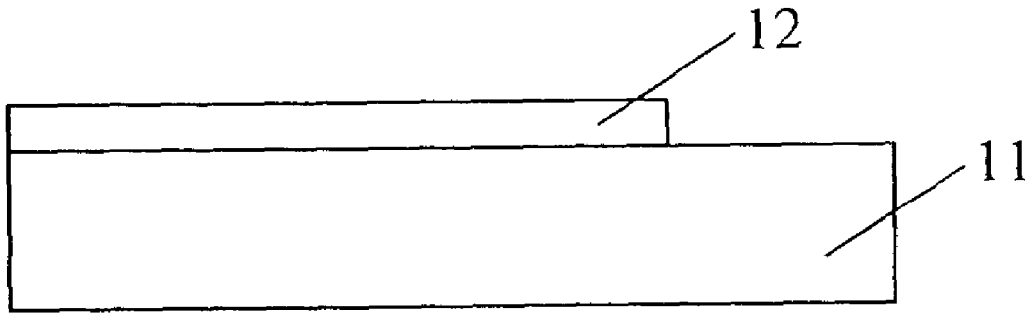
FIG. 4 is a side view showing the assembly of the sheathing panel having the vapor, water and ice barrier placed thereon according to FIG. 2.

In a second embodiment of the invention as shown in FIGS. 2 and 4, the vapor, water and ice layer 12 is applied to the first face 13 or second face 14 of the sheathing panel 11 as described in any one of the methods above, except the vapor, water and ice layer 12 covers three-fourths of the width of the first face 13 or the second face 14 of the sheathing panel 11. In one example, the sheathing panel 11 will be 4 feet in width and the vapor, water and ice layer 12 will be three feet in width; hence, three-fourths of the width of the sheathing panel 11 is covered by the vapor, water and ice layer 12. The coverage of the first face 13 or the second face 14 of the sheathing panel 11 with the vapor, water and ice layer 12 is not limiting and can be adjusted according to the purpose of use.

The combination of the vapor, water and ice layer 12 and the sheathing panel 11 form an assembly 18, 19. The assembly 18, 19 is transported to the roof and secured thereto. In most cases, the assembly 18, 19 is nailed to the roof rafters. The nails penetrate the vapor, water ice layer 12. The vapor, water and ice layer 12 is permeable and seals to the nail precluding seepage of vapor, water or ice. For example, the eaves of the roof should be protected with the vapor, water and ice layer 12. The assembly 18, 19 will be secured to the areas above the eaves. As an option, seam tape (not shown) is placed over the areas where the assemblies 18, 19 abut each other from one of the assemblies 18, 19 to the abutting assembly 18, 19. The seam tape is made of vapor, water and ice resistant material just as the material for the vapor, water and ice layer 12. The seam tape is positioned over a gap between the abutting assemblies 18, 19 and overlaps each of the assemblies 18, 19. The seam tape can be pre-applied to one of the abutting assemblies 18, 19 so that when the assemblies 18, 19 are secured to the rafters of the roof, the seam tape only need be pressed onto the assembly 18, 19 not having the seam tape pre-attached thereto. The seam tape precludes vapor, water and ice from the area between the abutting assemblies 18, 19. The assembly 18, 19 eliminates the efforts of carrying a roll of the vapor, water and ice layer 12 to the roof, unrolling the roll on the roof, peeling the plastic film 17 from the vapor, water and ice layer 12 while standing on the roof and properly placing the vapor, water and ice layer 12 on the sheathing panels 11 of the roof.

In the preferred embodiment, the invention includes the process of pre-installing the vapor, water and ice layer 12 to the first face 13 or the second face 14 of the sheathing panel 11 before the sheathing panel 11 is assembled onto the rafters of a roof, comprising the steps of positioning the first face 13 or the second face 14 of the sheathing panel 11 in an upright or accessible position, peeling the plastic film 17 from the vapor, water and ice layer 12, thereby exposing the adhesive surface on the second side 16 of the vapor, water and ice layer 12, applying the adhesive surface of the vapor, and water and ice layer 12 onto the first face 13 or the second face 14 of the sheathing panel 11. Thereafter, the assembly 18, 19 is transported to the roof, and the assembly 18, 19 is attached to the rafters of the roof. In most cases, the assembly 18, 19 is nailed to the roof rafters. The nails penetrate the vapor, water ice layer 12. The vapor, water and ice layer 12 is permeable and seals to the nail precluding seepage of vapor, water or ice. As an option, the seam tape is placed over the areas where the assemblies 18, 19 abut each other from one of the assemblies 18, 19 to the abutting assembly 18, 19 to preclude vapor, water and ice from the area between the abutting assemblies 18, 19. The seam tape is positioned over a gap between the abutting assemblies 18, 19 and overlaps each of the assemblies 18, 19. In alternative embodiments, the adhesive is pre-applied or applied during the assembly to the sheathing panel 11, the vapor, water and ice layer 12 or both.

In an alternative embodiment, the vapor, water and ice layer 12 is sprayed onto the sheathing panel 11. In this embodiment, the adhesive is not required. After installation of the assembly 18, 19 onto the roof rafters as explained above, the seam tape is placed over the areas where the assemblies 18, 19 abut each other from one of the assemblies 18, 19 to the abutting assembly 18, 19 to preclude vapor, water and ice from the area between the abutting assemblies 18, 19. The seam tape is positioned over a gap between the abutting assemblies 18, 19 and overlaps each of the assemblies 18, 19.

In an alternative embodiment, the vapor, water and ice layer 12 is applied to the sheathing panel 11 by dipping the sheathing panel 11 into a dip tank (not shown) containing the vapor, water and ice layer 12 in a liquid form. In this embodiment, the adhesive is not required. After installation of the assembly 18, 19 onto the roof rafters as explained above, the seam tape is placed over the areas where the assemblies 18, 19 abut each other from one of the assemblies 18, 19 to the abutting assembly 18, 19 to preclude vapor, water and ice from the area between the abutting assemblies 18, 19. The seam tape is positioned over a gap between the abutting assemblies 18, 19 and overlaps each of the assemblies 18, 19.

Other objects, features and advantages will be apparent to those skilled in the art. While preferred embodiments of the present invention have been illustrated and described, this has been by way of illustration and the invention should not be limited except as required by the scope of the appended claims.

What is claimed is:

1. A method of assembling a roof having a plurality of roof rafters, the method comprising the steps in the sequence set forth:

a. manufacturing a first roofing panel assembly, said step consisting of providing an eave sheathing panel having a face and adhering a vapor, water, and ice resistant layer to said face; said manufacturing step being performed remotely from the roof;

b. transporting said first roofing panel assembly to the plurality of roof rafters and adjacent an eve of the roof;

c. nailing said first roofing panel assembly to at least one of the plurality of roof rafters;

d. manufacturing a second roofing panel assembly;

e. transporting said second roofing panel assembly to the plurality of roof rafters, adjacent said first roofing panel assembly and adjacent the eve of the roof;

f. nailing said second roofing panel assembly to at least one of the plurality of roof rafters; and g. sealing a gap located between said first roofing panel assembly and said second roofing panel assembly.

2. The method according claim 1, wherein said first roofing panel abuts said second roofing panel.

3. The method according claim 1, wherein said step of manufacturing a second roofing panel comprises the steps of providing at least one other roofing panel and securing at least one other vapor, water, and ice resistant layer to said at least other roofing panel.

4. The method according claim 1, wherein said step of sealing said gap is accomplished through the use of a seam tape.

* * * * *